US006768371B1

(12) United States Patent
Layton et al.

(10) Patent No.: US 6,768,371 B1
(45) Date of Patent: Jul. 27, 2004

(54) STABLE FLOATING GATE VOLTAGE REFERENCE USING INTERCONNECTED CURRENT-TO-VOLTAGE AND VOLTAGE-TO-CURRENT CONVERTERS

(75) Inventors: Kent D. Layton, Lehi, UT (US); Seth A. Cook, Eagle Mountain, UT (US)

(73) Assignee: AMI Semiconductor, Inc., Pocatello, ID (US)

( * ) Notice: Subject to any disclaimer, the term of this patent is extended or adjusted under 35 U.S.C. 154(b) by 1 day.

(21) Appl. No.: 10/393,333

(22) Filed: Mar. 20, 2003

(51) Int. Cl.[7] ..... G05F 1/10
(52) U.S. Cl. ..... 327/540
(58) Field of Search ..... 327/530, 534, 327/535, 537, 538, 540, 541, 543

(56) References Cited

U.S. PATENT DOCUMENTS

| | | | | |
|---|---|---|---|---|
| 5,184,061 A | | 2/1993 | Lee et al. | 323/265 |
| 5,629,891 A | | 5/1997 | LeMoncheck et al. | 365/185.03 |
| 5,898,613 A | | 4/1999 | Diorio et al. | 365/185.03 |
| 6,133,780 A | | 10/2000 | Chi | 327/541 |
| 6,150,872 A | | 11/2000 | McNeill et al. | 327/539 |
| 6,215,352 B1 | | 4/2001 | Sudo | 327/530 |
| 6,218,822 B1 | | 4/2001 | MacQuigg | 323/313 |
| 6,297,689 B1 | | 10/2001 | Merrill | 327/540 |
| 6,362,612 B1 | | 3/2002 | Harris | 323/312 |
| 6,381,491 B1 | | 4/2002 | Maile et al. | 607/2 |
| 6,414,536 B1 | * | 7/2002 | Chao | 327/540 |
| 6,441,680 B1 | | 8/2002 | Leung et al. | 327/541 |

* cited by examiner

*Primary Examiner*—Jeffrey Zweizig
(74) *Attorney, Agent, or Firm*—Workman Nydegger

(57) ABSTRACT

A programmable voltage reference circuit that includes a current-to-voltage converter circuit, a voltage-to-current converter circuit, and a floating gate. The current-to-voltage converter circuit has two current input terminals and a voltage output terminal. The voltage-to-current converter circuit has two voltage input terminals and two current output terminals. The two current output terminals are each coupled to a corresponding current input terminal of the current-to-voltage converter circuit. A floating gate device has one terminal coupled to a fixed voltage supply, and one terminal coupled to an input terminal of the voltage-to-current converter. The other input terminal of the voltage-to-current converter is coupled to the voltage reference output terminal of the programmable voltage reference circuit. Also, the voltage output terminal of the current-to-voltage converter circuit is coupled to the negative voltage input terminal of the voltage-to-current input circuit.

15 Claims, 3 Drawing Sheets

STABLE FLOATING GATE VOLTAGE REFERENCE USING INTERCONNECTED CURRENT-TO-VOLTAGE AND VOLTAGE-TO-CURRENT CONVERTERS

BACKGROUND OF THE INVENTION

1. The Field of the Invention

The invention relates generally to analog voltage reference circuits, and more specifically, to programmable voltage reference circuits that use a floating gate to provide a constant charge from which a relatively stable reference voltage may be generated in a manner that is relatively stable over temperature and power supply variations.

2. Background and Related Art

The widespread distribution and advancement of integrated circuits has revolutionized our way of life. Voltage references are typically a key supporting circuit for many fundamental components of analog or mixed-signal integrated circuits. For example, operational amplifiers, voltage comparators, filters, digital-to-analog converter circuits, analog-to-digital converter circuits, all often use voltage references. The voltage reference is typically supplied by a voltage reference circuit. It is often advantageous to the operation of the analog circuit components if the voltage reference circuit is designed to generate a voltage reference that is less dependent on temperature and supply voltage fluctuations.

In the past, many voltage reference circuits have been based on the bandgap voltage of bipolar npn or pnp transistors. Many conventional voltage reference circuits are fabricated using CMOS technology but include parasitic bipolar transistors that are manufactured using custom CMOS processes. The parasitic bipolar transistors are difficult to match and thus have unsupported and inaccurate simulation models as such parasitic bipolar transistors are poorly manufactured and poorly characterized in an otherwise purely CMOS process. Another shortcoming is the difficulty in programming the reference voltage due to needing a post-fabrication programming method, which is usually expensive, time consuming, and/or requires special machinery or external circuitry. Also, many bandgap voltage reference circuits require the matching and cancellation of resistor temperature coefficients, which arc commonly very large and difficult to match.

There have been efforts made to create voltage reference circuits in CMOS processes without using parasitic bipolar devices and without using integrated resistors. Such conventional voltage reference circuits are often not trinmmable and thus compensation for inevitable process deviations is problematic. Furthermore, much of the research in this area is focused on resistor matching on the reference voltage stability.

In the last few decades, floating-gate transistors, which were until then primarily used in digital EEPROM cells, have often been used in analog circuits as a good solution for post-fabrication trimmability. The floating-gate devices are usually MOS transistors with two polysilicon gates, one being fully insulated by oxide layers. Charge can be put on or taken from this insulated gate by Fowler-Nordheim tunneling and/or impact-ionized hot-electron injection as is well known to those of ordinary skill in the art.

Some conventional technology involves the use of floating-gate transistors as a viable alternative to laser trimming, fuse blowing, and digitally controlled resistor trees in a wide variety of analog circuits and building blocks. More recently, voltage reference circuits using one or more floating-gate MOS devices have become common. In conventional technology, the charge on an insulated gate is used to create a voltage, which is then buffered to provide a low temperature coefficient CMOS voltage reference, as shown in FIG. 4. This architecture resolves the shortcomings of bandgap voltage reference circuits mentioned above. Specifically, it uses no parasitic bipolar transistors, is easily programmable, and uses no integrated resistor. However, the external precision resistors needed for accurate operation make it less useful for fully integrated systems. Also, the insulated gate used in this architecture is very sensitive to capacitive coupling to the drain and source of the transistor, which causes the output voltage to change unnecessarily due to temperature and power supply variations. In one conventional technology, two such floating-gate devices are used where the threshold voltage of each device can be programmed independently, as shown in FIG. 5. The difference between the two threshold voltages is applied across a diode-connected transistor and is used as the voltage reference output. This architecture also overcomes many of the shortcomings of the bandgap voltage reference circuits and can be fully integrated, but is sensitive to capacitive coupling to other nodes in the circuit. In addition, this architecture requires a voltage reference input of its own.

It would therefore represent an advancement to the art to invent a voltage reference circuit that demonstrates the advantages of floating-gate voltage reference circuits over bandgap voltage reference circuits but overcomes their shortcomings. Especially included in the list of advantageous features are:

1. The property of using only devices that can be easily fabricated and modeled in standard CMOS process, i.e, no parasitic bipolar transistors.
2. The property of being easily programmed across a useful range of reference voltages.
3. The property of not requiring resistors, especially the matching and cancellation of the temperature coefficients of such resistors.
4. The property of being fully integratable.
5. The property of being completely self-contained, i.e, no external voltage references needed.
6. The property of eliminating output voltage variations due to capacitive coupling to the floating gate through temperature and supply voltage fluctuations.

BRIEF SUMMARY OF THE INVENTION

The foregoing problems with the prior state of the art are overcome by the principles of the present invention, which is directed towards a programmable voltage reference circuit that includes a reference voltage output terminal upon which the reference voltage is to be asserted during cooperative interaction of an included current-to-voltage converter circuit, a voltage-to-current converter circuit, and a floating gate.

The current-to-voltage converter circuit has two current input terminals and a voltage output terminal. The voltage-to-current converter circuit has two voltage input terminals and two current output terminals. The two current output terminals are each coupled to a corresponding current input terminal of the current-to-voltage converter circuit. A floating gate device has one terminal coupled to a fixed voltage supply, and one terminal coupled to an input terminal of the voltage-to-current converter. The other input terminal of the voltage-to-current converter is coupled to the voltage reference output terminal of the programmable voltage reference circuit. Also, the voltage output terminal of the current-to-voltage converter circuit is coupled to the negative voltage input terminal of the voltage-to-current converter input circuit. This negative feedback results in the circuit as a whole operating as a unity gain buffer. Such a design enables five of the six advantages enumerated above. The sixth advantage may be obtained by structuring the voltage-to-current and current-to-voltage converter circuit in one of several manners as described further below.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The principles of the present invention are directed towards a programmable voltage reference that has the following advantages:

1) may be fabricated using standard Complementary Metal Oxide Semiconductor (CMOS) processes without using parasitic bipolar transistors (hereinafter also referred to as "the first advantage",
2) is easily programmed across a useful range of reference voltages (hereinafter also referred to as "the second advantage"),
3) does not require resistors and thus the matching and cancellation of the temperature coefficient of such resistors (hereinafter also referred to as "the third advantage"),
4) is fully integratable (hereinafter also referred to as "the fourth advantage"),
5) is self-contained with no external voltage references needed (hereinafter also referred to as "the fifth advantage"), and
6) eliminates output voltage variations due to capacitive coupling of the floating gate through temperature and supply voltage variations.

Figure 1:
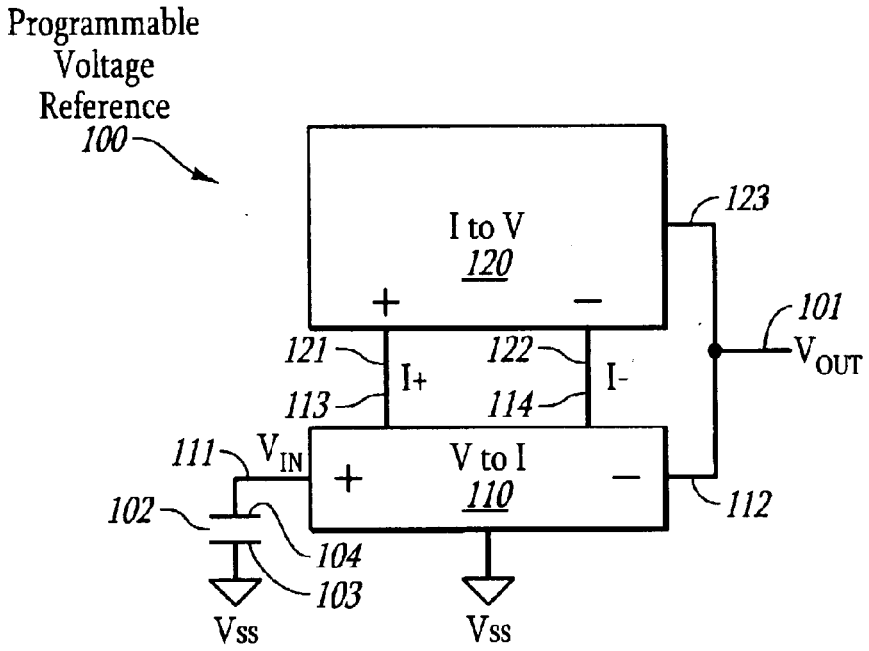
FIG. 1 illustrates a general embodiment of a programmable voltage reference circuit in accordance with the present invention in which a floating gate, a current-to-voltage converter circuit, and a voltage-to-current converter circuit interact to generate a voltage reference.

FIG. 1 illustrates a general embodiment of the present invention in the form of a programmable voltage reference circuit 100. The circuit 100 includes a reference voltage output terminal 101 upon which the reference voltage $V_{OUT}$ is to be asserted during operation of the programmable voltage reference circuit in a manner that will now be described.

The circuit 100 includes a floating gate device 102 that may include any structure that has a floating gate that can be programmed so as to change a voltage between one terminal 103 of the floating gate 102 and the other terminal 104 of the floating gate 102. Generally speaking, when referring to floating gate technology, "programming" refers to the use of Fowler-Nordheim tunneling or impact-ionized hot-electron injection to insert electrons or the use of Fowler-Nordheim tunneling to remove electrons from the floating gate.

The programmed voltage applied between the terminals 103 and 104 of the floating gate 102 will be designated herein as $V_{IN}$. By applying different magnitudes of charge on the floating gate, a wide useful range of voltages may be obtained for $V_{IN}$. Accordingly, the voltage $V_{IN}$ is designated herein as a "programmable voltage". Typical structures for the floating gate may include a floating gate capacitor or a floating gate transistor or a floating gate transistor that has its source and drain terminals coupled to voltage sufficient to reverse bias the source-body and drain-body pn junctions.

One terminal 103 of the floating gate 102 is coupled to a relatively fixed floating gate voltage source. In this description and in the claims, a "relatively fixed floating gate voltage source" means a voltage source that is fixed within a range that is less than the difference between the voltage of the floating gate 102 when programmed, and the voltage of the floating gate 102 when the floating gate 102 is not programmed. In this illustrated example, the terminal 103 is coupled to a low voltage source $V_{SS}$.

The other terminal 104 of the floating gate 102 carrying voltage $V_{IN}$ is coupled to the positive input terminal 111 of a differential voltage-to-current converter circuit 110. A negative input terminal 112 of the differential voltage-to-current converter circuit 110 is coupled to the output terminal 101 of the programmable voltage reference circuit 100 that carries voltage $V_{OUT}$. The differential voltage-to-current converter circuit 110 has output currents $I^+$ and $I^-$ applied on respective output terminals 113 and 114. It follows from the basic functionality of a voltage-to-current converter circuit that the following Equation 1 is true:

$$I^+ - I^{31} = A_1(V_{IN} - V_{OUT}) = A_1 V_{IN} - A_1 V_{OUT} \quad (1)$$

where $A_1$ is the transconductance gain of the voltage-to-current converter circuit 110.

The programmable voltage reference circuit 100 also includes a current-to-voltage converter circuit 120 having first and second current input terminals 121 and 122 and a voltage output terminal 123. The first current output terminal 113 of the voltage-to-current converter circuit 110 is coupled to the first current input terminal 121 of the current-to-voltage converter circuit 120. Furthermore, the second current output terminal 114 of the voltage-to-current converter circuit 110 is coupled to the second current input terminal 122 of the current-to-voltage converter circuit 120. The voltage output terminal 123 of the current-to-voltage converter circuit 120 is coupled to the second voltage input terminal 112 of the voltage-to-current converter circuit 110 and to the reference voltage output terminal 101 of the programmable voltage reference circuit 100.

It follows from the basic functionality of current-to-voltage differential input to single-ended output circuit that the following Equation 2 is true:

$$V_{OUT}=A_2(I^+-I^-) \tag{2}$$

where $A_2$ is the transresistance gain of the current-to-voltage converter circuit 120.

Since the output terminal 123 of the current-to-voltage converter circuit 120 ($V_{OUT}$) is coupled back to the negative input terminal 112 of the voltage-to-current converter circuit 110, the complete circuit exhibits negative feedback and acts as a unity gain buffer.

This effect can be seen mathematically by substituting Equation 2 into Equation 1, to get the following Equation 3:

$$\frac{V_{OUT}}{A_2} = A_1(V_{IN} - V_{OUT}) = A_1V_{IN} - A_1V_{OUT} \tag{3}$$

Solving Equation 3 for $V_{out}$ gives the following Equation 4:

$$V_{OUT} = V_{IN}\left(\frac{A_1A_2}{1 + A_1A_2}\right) \tag{4}$$

Therefore, the output voltage $V_{OUT}$ is approximately equal to $V_{IN}$, if the product of the gains $A_1$ and $A_2$ is much greater than one. This is true even if the transconductance gain $A_1$ of the voltage-to-current converter 110 and the transresistance gain $A_2$ of the current-to-voltage converter 120 have a strong dependence on process and temperature variations. Accordingly, this unity gain buffer architecture allows the programmable voltage reference circuit 100 to compensate for changes in process and temperature. The programmable voltage reference circuit 100 also allows the circuit to drive the typical loads seen by voltage reference circuits.

The programmable voltage reference circuit 100 of FIG. 1 has the first advantage as floating gate devices, current-to-voltage converter circuits and voltage-to-current circuits may be fabricated using standard CMOS processes and without using parasitic bipolar transistors. Accordingly, the complexity and cost associated with fabricating the programmable voltage reference circuit 100 are reduced.

The programmable voltage reference circuit 100 has the second advantage in that the floating gate 102 may be programmed to a wide range of useful voltages thereby allowing the programmable voltage reference output to be programmed to a wide range of programmable voltage references.

The programmable voltage reference circuit 100 has the third advantage in that the floating gate device, current-to-voltage converter circuit and voltage-to-current converter circuit may be fabricated without using resistors.

The programmable voltage reference circuit 100 has the fourth advantage in that the floating gate device, current-to-voltage converter circuit and voltage-to-current converter circuit may be fully integratable onto the same chip.

The programmable voltage reference circuit 100 has the fifth advantage in that the floating gate device, current-to-voltage converter circuit and voltage-to-current converter circuit need no external voltage reference.

Figure 2:
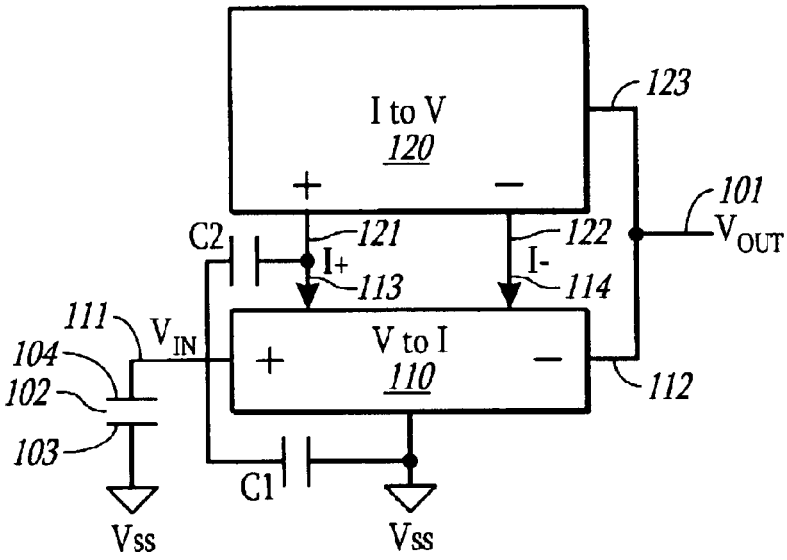
FIG. 2 illustrates the programmable voltage reference of FIG. 1 in which certain relevant parasitic capacitors are also illustrated.
Figure 3:
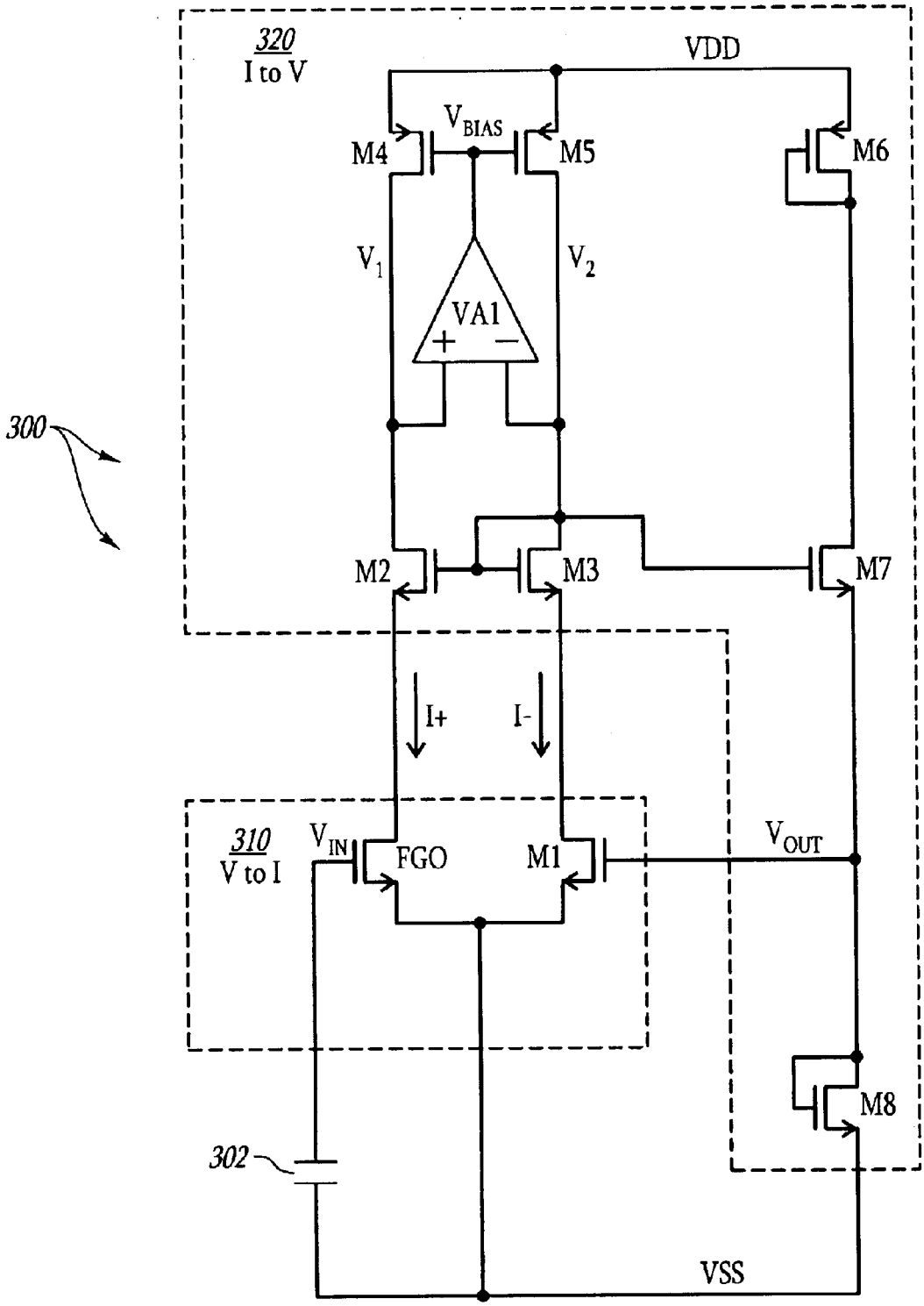
FIG. 3 illustrates a specific embodiment of the programmable voltage reference of FIG. 1 that generates a reference voltage that has the property of eliminating output variations due to capacitive coupling of the floating gate through temperature and supply voltage fluctuations.
Figure 4:
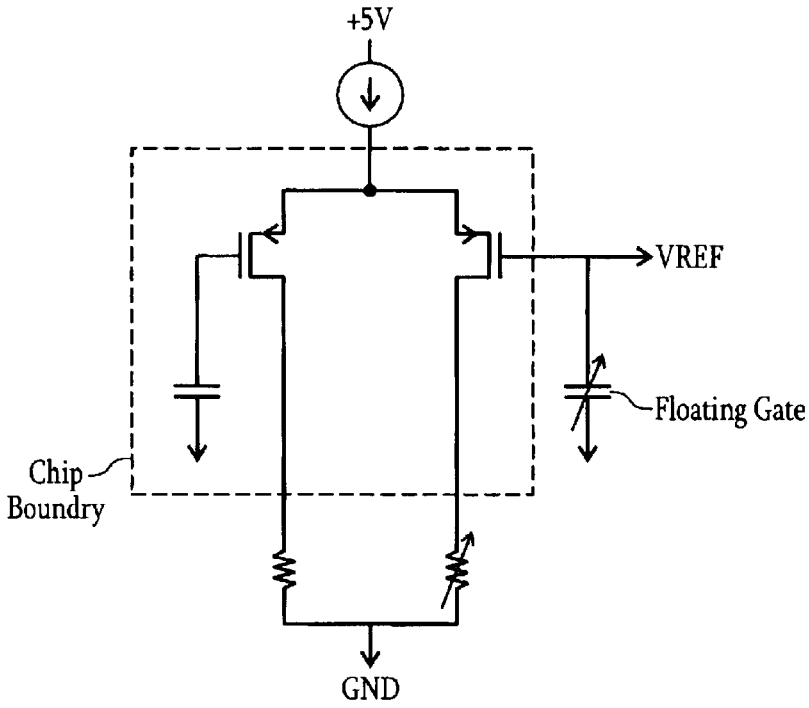
FIG. 4 (PRIOR ART)
FIG. 4 illustrates a voltage reference circuit in accordance with one aspect of the prior art.
Figure 5:
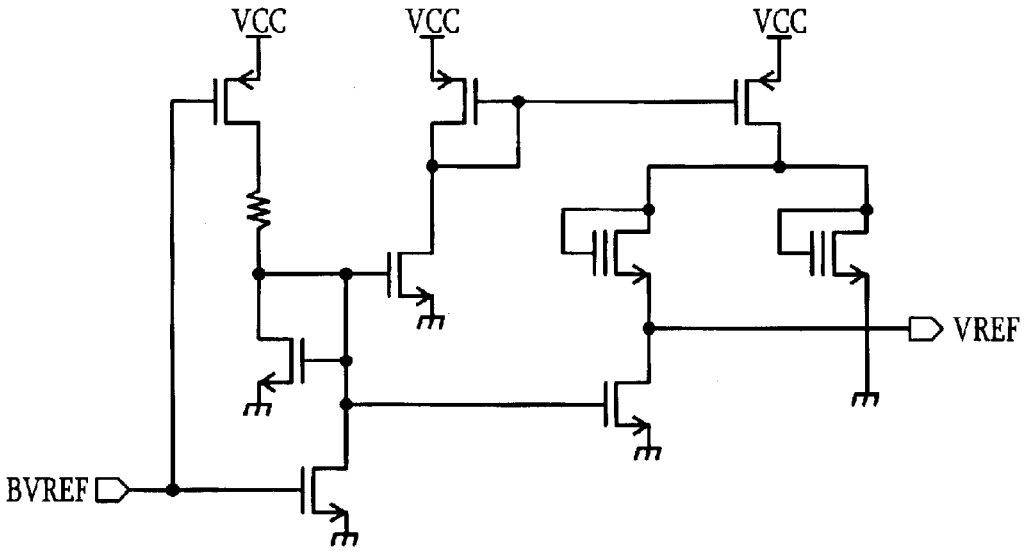
FIG. 5 (PRIOR ART)
FIG. 5 illustrates a voltage reference circuit in accordance with another aspect of the prior art.

As for the sixth advantage, FIG. 2 shows the programmable voltage reference circuit of FIG. 1 with relevant parasitic capacitors $C_1$ and $C_2$ included. Since parasitic capacitor $C_1$ is coupled to the ground node, it will have no effect on the floating-gate voltage $V_{IN}$. Parasitic capacitor $C_2$, however, will couple changes in the voltage at the positive current output terminal 113 of the voltage-to-current converter circuit 110 directly to positive voltage input terminal 111 having the programmable voltage $V_{IN}$. As shown in Equation 4 any changes in $V_{IN}$ will transfer to $V_{OUT}$. FIG. 3 illustrates a programmable voltage reference circuit 300 in accordance with a more specific embodiment of the present invention.

The programmable voltage reference circuit 300 includes a floating gate 302, a voltage-to-current converter circuit 310 and a current-to-voltage converter circuit 320 that operate and are configured with respect to each other in the same manner as described above for the floating gate 102, the voltage-to-current converter circuit 110 and the current-to-voltage converter circuit 120 respectively of FIG. 1. However, FIG. 3 illustrated a specific example of how the current-to-voltage converter circuit 310 and the voltage-to-current converter circuit 320 may be structured to enable the sixth advantage involving the elimination of output voltage variations due to capacitive coupling of the floating gate through temperature and supply voltage variations as will now be described. As will be apparent to those of ordinary skill in the art after having reviewed this description, other specific current-to-voltage and voltage-to-current circuit configurations may accomplish a similar effect.

The voltage-to-current converter circuit 310 comprises NMOS transistors FGO and M1, which are arranged in a differential pair configuration by coupling the source terminal of each transistor to the VSS node. The gate terminal of the NMOS transistor FGO is the positive voltage input terminal of the voltage-to-current converter circuit 310. The gate terminal of the NMOS transistor M1 is the negative voltage input terminal of the voltage-to-current converter circuit 310. The drain terminal of NMOS transistor FGO and the drain terminal of the NMOS transistor M1 are the first and second current output terminals, respectively, of the voltage-to-current converter circuit 310.

The difference in the currents, $I^+$ and $I^-$, being pulled by transistors FGO and M1 respectively, is proportional to the difference in the voltages being applied at their gate terminals. The voltage applied at the gate terminal of FGO ($V_{IN}$) is the voltage caused by the charge stored on the floating gate using Fowler-Nordheim tunneling or impact-ionized hot-electron injection. The voltage applied at the gate terminal of M1, ($V_{OUT}$), is the output of the entire voltage reference circuit being coupled to the negative input terminal of the voltage-to-current converter circuit, forming a negative feedback loop. As was shown in Equation 4 above, $V_{OUT}$ is approximately equal to $V_{IN}$ due to this negative feedback. Because the difference between the input voltages is effectively zero, the output currents $I^+$ and $I^-$ are effectively equal. This equality plays a very important role in the output voltage stability over temperature and supply voltage as will be demonstrated.

The rest of the transistors M2 through M8 and the amplifier VA1 comprise a differential current-to-voltage converter circuit 320. The source terminals of NMOS transistors M2 and M3 are the positive and negative current input terminals, respectively, of the current-to-voltage reference circuit 320. The gate terminal of NMOS transistor M2 and the gate and drain terminals of NMOS transistor M3 are connected. Since the input currents $I^+$ and $I^-$ are equal, the voltage at the gate terminals of NMOS transistors FGO and M1 are equal, as are the gate terminals of NMOS transistors M2 and M3, the voltage at the drain terminals of NMOS transistors FGO and M1 will be equal as will the drain terminals of NMOS transistors M2 and M3.

The drain terminals of M2 and M3 are coupled to the drain terminals of PMOS transistors M4 and M5 respectively. PMOS transistors M4 and M5 are used as resistive loads to convert the currents $I^+$ and $I^-$ into voltages $V_1$ and $V_2$ at the drains of PMOS transistors M4 and M5 respectively. The gate terminals of PMOS transistors M4 and M5 are coupled to each other so that the loads they present to the rest of the circuit are equivalent. The voltage on these gate terminals, $V_{BIAS}$, is controlled by voltage amplifier VA1, whose inputs are the voltages at the drain terminals of M2 and M3. This voltage amplifier regulates the load PMOS transistors M4 and M5 so that they remain in their active load region regardless of the input voltage $V_{IN}$. This allows the source terminals of NMOS transistors FGO and M1 to be connected to $V_{SS}$, where typically an additional NMOS transistor would be required to regulate the total current available to flow through NMOS transistors FGO and M1. This is important because connecting the source terminal of NMOS transistor FGO to $V_{SS}$ eliminates the variations of the voltage at the source terminal and therefore eliminates the variations of $V_{IN}$ due to the parasitic capacitance $C_1$ between the source and gate terminals of the NMOS transistor FGO, which voltage variations would then be coupled directly to $V_{OUT}$.

To be able to drive large loads, the voltage $V_2$ is coupled to the gate terminal of NMOS transistor M7. The gate and drain terminals of PMOS transistor M6 are both coupled to the drain terminal of NMOS transistor M7 to provide a diode load to NMOS transistor M7. Similarly, the gate and drain terminals of NMOS transistor M8 are both coupled to the source terminal of NMOS transistor M7 to provide a diode load to NMOS transistor M7. Connecting the source terminal of M7 to the gate terminal of NMOS transistor M1 provides the negative feedback loop described above which keeps $V_{out}$ approximately equal to $V_{in}$ even when NMOS transistors M7 and M8 are required to provide large amounts of current to do so.

Since the negative feedback keeps $V_{out}$, equal to $V_{in}$ and $I^+$ equal to $I^-$ the drain voltages of NMOS transistors FGO and M1 remain extremely stable over temperature and power supply variations. This is because the gate to source voltage drop of NMOS transistors M2, M3, and M7 are all equal to the threshold voltage, $V_{th}$, of an NMOS transistor, keeping the gate terminals of NMOS transistors M2, M3, and M7 at $V_{OUT}+V_{th}$, and the drain terminals of NMOS transistors FGO and M1 at approximately $V_{OUT}$. Since the threshold voltage of NMOS transistors M2, M3, and M7 all change the same over temperature and not at all due to power supply variations, the drain terminal of FGO remains equal to $V_{OUT}$ which in turn is kept equal to $V_{IN}$ by the negative feedback loop mentioned earlier. This minimizes greatly the variations of $V_{IN}$ over temperature and power supply which would otherwise occur due to the parasitic capacitance between the drain and gate terminals of NMOS transistor FGO and therefore minimizes the variations of $V_{OUT}$.

The architecture shown can be designed using only integratable MOS transistors, specifically requiring no precision resistors or parasitic bipolar devices. This allows for a practical and inexpensive voltage reference that is easily modeled and fabricated by a standard CMOS fabrication facility. No external biasing or start-up circuits are necessary for operation, keeping the circuit completely autonomous. Because the differential pair formed by transistors FGO and M1 can operate over a relatively large input voltage range and the floating gate can be easily programmed over the same range, this circuit can easily provide a wide, useful range of reference voltages. Finally, the mechanisms described eliminate the variations in $V_{OUT}$ due to variations in the nodes that are capacitively coupled to the floating gate, giving a more stable voltage reference.

While the principles of the present invention have been described with respect to the specific embodiments illustrated in FIGS. 1 through 3, various modifications, additions, and deletions will be obvious to those of ordinary skill in the art after having reviewed this description. For instance, all terminals that are described as being connected to a low voltage source $V_{SS}$ may instead be coupled to a high voltage source $V_{DD}$ with all NMOS transistors replaced by PMOS transistors, and all PMOS transistors replaced by NMOS transistors.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes, which come within the meaning and range of equivalency of the claims, are to be embraced within their scope.

What is claimed and desired secured by United States Letters Patent is:

What is claimed is:

1. A programmable voltage reference circuit comprising the following:

a reference voltage output terminal upon which the reference voltage is to be asserted during operation of the programmable voltage reference circuit;

a current-to-voltage converter circuit having first and second current input terminals and a voltage output terminal;

a voltage-to-current converter circuit having first and second voltage input terminals and first and second current output terminals, the first current output terminal coupled to the first current input terminal, the second current output terminal coupled to the second current input terminal, the voltage output terminal of the current-to-voltage converter circuit coupled to the second voltage input terminal of the voltage-to-current converter circuit and to the reference voltage output terminal of the programmable voltage reference circuit; and a floating gate device having at least two terminals and a floating gate capacitively coupled between the two terminals of the floating gate device, a first terminal of the floating gate device coupled to the first voltage input terminal of the voltage-to-current converter circuit, the second terminal of the floating gate device coupled to a substantially fixed voltage source.

2. A programmable voltage reference circuit in accordance with claim 1, wherein the voltage-to-current converter circuit comprises the following:

a first NMOS transistor having a gate terminal coupled to the first voltage input terminal of the voltage-to-current converter circuit, a drain terminal coupled to the first current output terminal of the voltage-to-current converter circuit, and a source terminal; and a second NMOS transistor having a gate terminal coupled to the second voltage input terminal of the voltage-to-current converter circuit, a drain terminal coupled to the second current output terminal of the voltage-to-current converter circuit, and a source terminal coupled to the source terminal of the first NMOS transistor.

3. A programmable voltage reference circuit in accordance with claim 2, wherein the source terminals of the first and second NMOS transistors are coupled to the substantially fixed voltage source.

4. A programmable voltage reference circuit in accordance with claim 3, wherein the substantially fixed voltage source is a low supply voltage.

5. A programmable voltage reference circuit in accordance with claim 4, wherein the current-to-voltage converter circuit comprises the following:

a third NMOS transistor having a source terminal coupled to the first current input terminal of the current-to-voltage converter circuit, a gate terminal, and a drain terminal;

a fourth NMOS transistor having a source terminal coupled to the second current input terminal of the current-to-voltage converter circuit, a gate terminal coupled to the gate terminal of the third NMOS transistor, and a drain terminal that is coupled to the gate terminal of the fourth NMOS transistor;

a voltage amplifier having a first input terminal coupled to the drain terminal of the third NMOS transistor, a second input terminal coupled to the drain of the fourth NMOS transistor, and an output terminal;

a first PMOS transistor having a source terminal coupled to a high voltage source, a gate terminal coupled to the output terminal of the voltage amplifier, and a drain terminal coupled to the drain terminal of the third NMOS transistor; and a second PMOS transistor having a source terminal coupled to the high voltage source, a gate terminal coupled to the output terminal of the voltage amplifier, and a drain terminal coupled to the drain terminal of the fourth NMOS transistor.

6. A programmable voltage reference circuit in accordance with claim 5, wherein the current-to-voltage reference circuit further comprises the following:

a third PMOS transistor having a source terminal coupled to the high voltage source, and a gate terminal and a drain terminal that are coupled together;

a fifth NMOS transistor having a source terminal coupled to the voltage output terminal of the current-to-voltage converter circuit, a gate terminal coupled to the drain terminal of the fourth NMOS transistor, and a drain terminal coupled to the drain terminal of the third PMOS transistor; and a sixth NMOS transistor having a source terminal coupled to the low voltage source, and a gate terminal and a drain terminal coupled together and to the source terminal of the fifth NMOS transistor.

7. A programmable voltage reference circuit in accordance with claim 1, wherein the current-to-voltage converter circuit comprises the following:

a first NMOS transistor having a source terminal coupled to the first current input terminal of the current-to-voltage converter circuit, a gate terminal, and a drain terminal;

a second NMOS transistor having a source terminal coupled to the second current input terminal of the current-to-voltage converter circuit, a gate terminal coupled to the gate terminal of the first NMOS transistor, and a drain terminal that is coupled to the gate terminal of the second NMOS transistor;

a voltage amplifier having a first input terminal coupled to the drain terminal of the first NMOS transistor, a second input terminal coupled to the drain of the second NMOS transistor, and an output terminal;

a first PMOS transistor having a source terminal coupled to a high voltage source, a a gate terminal coupled to the output terminal of the voltage amplifier, and a drain terminal coupled to the drain terminal of the first NMOS transistor; and a second PMOS transistor having a source terminal coupled to the high voltage source, a gate terminal coupled to the output terminal of the voltage amplifier, and a drain terminal coupled to the drain terminal of the second NMOS transistor.

8. A programmable voltage reference circuit in accordance with claim 7, wherein the current-to-voltage reference circuit further comprises the following:

a third PMOS transistor having a source terminal coupled to the high voltage source, and a gate terminal and a drain terminal that are coupled together;

a third NMOS transistor having a source terminal coupled to the voltage output terminal of the current-to-voltage converter circuit, a gate terminal coupled to the drain terminal of the second NMOS transistor, and a drain terminal coupled to the drain terminal of the third PMOS transistor; and a fourth NMOS transistor having a source terminal coupled to the low voltage source, and a gate terminal and a drain terminal coupled together and to the source terminal of the third NMOS transistor.

9. A programmable voltage reference circuit in accordance with claim 1, wherein the voltage-to-current converter circuit comprises the following:

a first PMOS transistor having a gate terminal coupled to the first voltage input terminal of the voltage-to-current converter circuit, a drain terminal coupled to the first current output terminal of the voltage-to-current converter circuit, and a source terminal; and a second PMOS transistor having a gate terminal coupled to the second voltage input terminal of the voltage-to-current converter circuit, a drain terminal coupled to the second current output terminal of the voltage-to-current converter circuit, and a source terminal coupled to the source terminal of the first PMOS transistor.

10. A programmable voltage reference circuit in accordance with claim 9, wherein the source terminals of the first and second PMOS transistors are coupled to the substantially fixed voltage source.

11. A programmable voltage reference circuit in accordance with claim 9, wherein the substantially fixed voltage source is a high supply voltage.

12. A programmable voltage reference circuit in accordance with claim 11, wherein the current-to-voltage converter circuit comprises the following:

a third PMOS transistor having a source terminal coupled to the first current input terminal of the current-to-voltage converter circuit, a gate terminal, and a drain terminal;

a fourth PMOS transistor having a source terminal coupled to the second current input terminal of the current-to-voltage converter circuit, a gate terminal coupled to the gate terminal of the third PMOS transistor, and a drain terminal that is coupled to the gate terminal of the fourth PMOS transistor;

a voltage amplifier having a first input terminal coupled to the drain terminal of the third PMOS transistor, a second input terminal coupled to the drain of the fourth PMOS transistor, and an output terminal;

a first NMOS transistor having a source terminal coupled to a low voltage source, a gate terminal coupled to the output terminal of the voltage amplifier, and a drain terminal coupled to the drain terminal of the third PMOS transistor; and a second NMOS transistor having a source terminal coupled to the low voltage source, a gate terminal coupled to the output terminal of the voltage amplifier, and a drain terminal coupled to the drain terminal of the fourth PMOS transistor.

13. A programmable voltage reference circuit in accordance with claim 12, wherein the current-to-voltage reference circuit further comprises the following:

a third NMOS transistor having a source terminal coupled to the low voltage source, and a gate terminal and a drain terminal that are coupled together;

a fifth PMOS transistor having a source terminal coupled to the voltage output terminal of the current-to-voltage converter circuit, a gate terminal coupled to the drain terminal of the fourth PMOS transistor, and a drain terminal coupled to the drain terminal of the third NMOS transistor; and a sixth PMOS transistor having a source terminal coupled to the low voltage source, and a gate terminal and a drain terminal coupled together and to the source terminal of the fifth PMOS transistor.

14. A programmable voltage reference circuit in accordance with claim 1, wherein the current-to-voltage converter circuit comprises the following:

a first PMOS transistor having a source terminal coupled to the first current input terminal of the current-to-voltage converter circuit, a gate terminal, and a drain terminal;

a second PMOS transistor having a source terminal coupled to the second current input terminal of the current-to-voltage converter circuit, a gate terminal coupled to the gate terminal of the first PMOS transistor, and a drain terminal that is coupled to the gate terminal of the second PMOS transistor;

a voltage amplifier having a first input terminal coupled to the drain terminal of the first PMOS transistor, a second input terminal coupled to the drain of the second PMOS transistor, and an output terminal;

a first NMOS transistor having a source terminal coupled to a low voltage source, a gate terminal coupled to the output terminal of the voltage amplifier, and a drain terminal coupled to the drain terminal of the first PMOS transistor; and a second NMOS transistor having a source terminal coupled to the high voltage source, a gate terminal coupled to the output terminal of the voltage amplifier, and a drain terminal coupled to the drain terminal of the second PMOS transistor.

15. A programmable voltage reference circuit in accordance with claim 14, wherein the current-to-voltage reference circuit further comprises the following:

a third NMOS transistor having a source terminal coupled to the high voltage source, and a gate terminal and a drain terminal that are coupled together;

a third PMOS transistor having a source terminal coupled to the voltage output terminal of the current-to-voltage converter circuit, a gate terminal coupled to the drain terminal of the second PMOS transistor, and a drain terminal coupled to the drain terminal of the third NMOS transistor; and a fourth PMOS transistor having a source terminal coupled to the low voltage source, and a gate terminal and a drain terminal coupled together and to the source terminal of the third PMOS transistor.

* * * * *

UNITED STATES PATENT AND TRADEMARK OFFICE

CERTIFICATE OF CORRECTION

PATENT NO. : 6,768,371 B1 
DATED : July 27, 2004
INVENTOR(S) : Kent D. Layton and Seth A. Cook It is certified that error appears in the above-identified patent and that said Letters Patent is hereby corrected as shown below:

Column 1,
Line 45, before "commonly" change "arc" to -- are --

Column 2,
Line 53, before "directed" change "is" to -- are --

Column 4,
Line 56, change "$I^{+} - I^{31} = A_1(V_{IN} - V_{OUT}) = A_1V_{IN} - A_1V_{OUT}$ (I)" to -- $I^{+} - I^{31} = A_1(V_{IN} - V_{OUT}) = A_1V_{IN} - A_1V_{OUT}$ (1) --

Column 5,
Line 11, change "$V_{OUT} = A_2(I^{+} - I^{`})$ (2)" to -- $V_{OUT} = A_2(I^{+} - I^{-})$ (2) --
Line 19, after "buffer." do not begin a new paragraph.

Column 6,
Line 23, after "FIG. 3" change "illustrated" to -- illustrates --

Signed and Sealed this

First Day of February, 2005

JON W. DUDAS
*Director of the United States Patent and Trademark Office*